US012247383B1

(12) United States Patent
Vitarelli et al.

(10) Patent No.: US 12,247,383 B1
(45) Date of Patent: Mar. 11, 2025

(54) STORMWATER SYSTEM HAVING MULTIPLE PLATES AND ONE-PIECE COLUMNS

(71) Applicant: Infiltrator Water Technologies, LLC, Old Saybrook, CT (US)

(72) Inventors: Ronald Vitarelli, Marlborough, CT (US); Paul Holbrook, Old Saybrook, CT (US); Bryan A Coppes, Old Saybrook, CT (US); Adam Miller, Haddam, CT (US)

(73) Assignee: Infiltrator Water Technologies, LLC, Old Saybrook, CT (US)

( * ) Notice: Subject to any disclaimer, the term of this patent is extended or adjusted under 35 U.S.C. 154(b) by 0 days.

(21) Appl. No.: 17/504,097

(22) Filed: Oct. 18, 2021

(51) Int. Cl.
*E03F 1/00* (2006.01)

(52) U.S. Cl.
CPC ..... *E03F 1/005* (2013.01)

(58) Field of Classification Search
CPC ..... E03F 1/002; E03F 1/003; E03F 1/005
See application file for complete search history.

(56) References Cited

U.S. PATENT DOCUMENTS

| | | | | |
|---|---|---|---|---|
| 3,245,365 | A | 4/1966 | Doherty | |
| 3,472,476 | A | 10/1969 | Johnson | |
| 4,688,684 | A | 8/1987 | Young et al. | |
| 6,260,488 | B1 | 7/2001 | Yang et al. | |
| 7,100,781 | B2 | 9/2006 | Craft | |
| 9,775,303 | B2 | 10/2017 | Ray et al. | |
| 9,896,832 | B2 | 2/2018 | Graf | |
| 9,950,835 | B2 | 4/2018 | Palmer | |
| 11,369,065 | B2 * | 6/2022 | Ray | A01G 13/0237 |
| 2002/0046982 | A1 | 4/2002 | Guizzardi | |
| 2017/0347539 | A1 * | 12/2017 | Ray | A01G 13/0237 |
| 2023/0113000 | A1 * | 4/2023 | Holbrook | E03F 5/14 210/170.03 |
| 2023/0116524 | A1 * | 4/2023 | Miller | E03F 5/14 405/36 |

FOREIGN PATENT DOCUMENTS

| | | | | |
|---|---|---|---|---|
| CN | 115787381 A * | 3/2023 | | E01C 11/22 |
| EP | 1820914 A1 * | 8/2007 | | E03F 1/005 |
| KR | 101437791 B1 * | 9/2014 | | |
| KR | 20180044184 A * | 5/2018 | | |

* cited by examiner

*Primary Examiner* — Frederick L Lagman
(74) *Attorney, Agent, or Firm* — FINNEGAN, HENDERSON, FARABOW, GARRETT & DUNNER L.L.P.

(57) ABSTRACT

A module that is useful for receiving stormwater when buried in permeable media comprises a base from which a plurality of columns extends upwardly, to support two or more different-elevation horizontal plates. Each plate has a plurality of holes, through each of which a column extends. The plates are secured to the columns at their respective elevations by self-acting engaging means comprising a latch, e.g. a peg extending radially from the column, and a mating receiver, e.g., an elastically deflectable plate having a hole that receives the peg. The angular orientation around the column of the self-acting engaging means varies with the plate elevation, so that for example, the first plate is only engageable at the first elevation and the second plate is only engageable at the second elevation. A module is assembled by lifting or lowering each plate along the column lengths until the plate becomes automatically engaged at the particular plate's predetermined elevation.

21 Claims, 9 Drawing Sheets

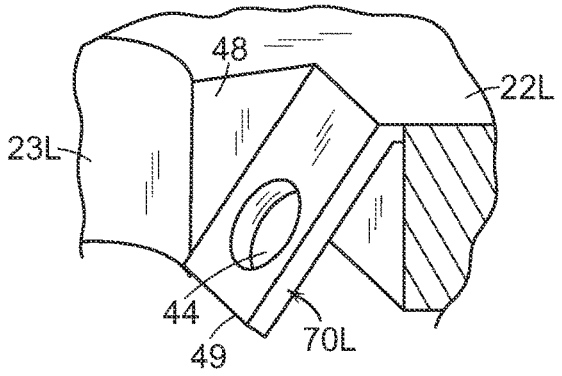
FIG. 11A
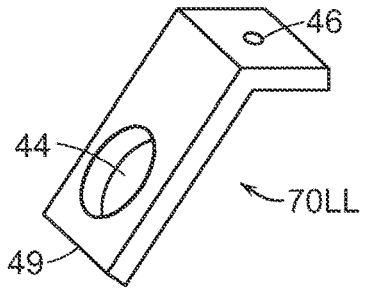
FIG. 11B
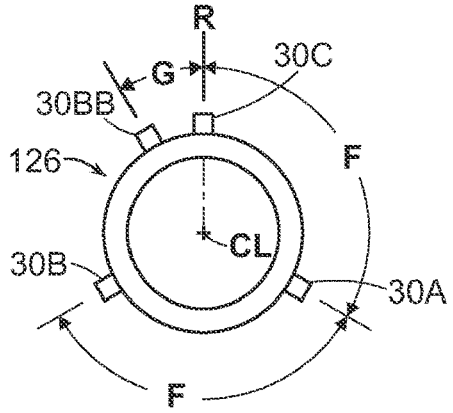
FIG. 12
FIG. 13
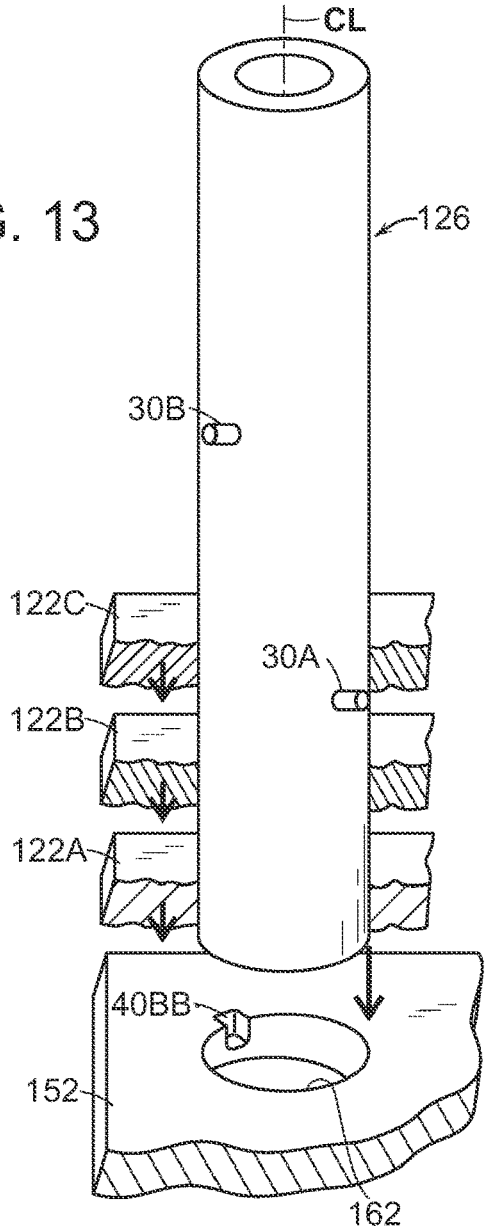

STORMWATER SYSTEM HAVING MULTIPLE PLATES AND ONE-PIECE COLUMNS

TECHNICAL FIELD

The present invention relates to plastic box-like structures, especially those that are useful for underground detention of stormwater.

BACKGROUND

There is a continuing engineering interest in economically detaining and dispersing stormwater such as that which falls on a large vehicle parking area of a shopping center or the like. Generally, the aim is slow the flow of a large quantity of runoff rainwater onto adjacent lands or into natural surface water courses. One approach is to channel stormwater from catch basins to an array of hollow structures that are buried beneath the parking lot. For example, rows of large plastic storm chambers having arch shaped cross section corrugated walls may be buried within crushed stone. See Smith et al. U.S. Pat. No. 6,991,734 for an example of a detention system comprising storm chambers. Over time, the stormwater may percolate into the surrounding earth or be controllably discharged to a water course.

Structures comprising plastic boxes/crates that are in adjacent rows, often stacked two or more high, have been used to create the large volume void space that is needed. Many such structures comprise a plurality of vertical pillars that support horizontal plates. Examples of such types of systems are shown in U.S. Pat. No. 10,563,391 Diskskotter and U.S. Pat. No. 9,506,235 Adams et al., and European patent publication EP2495373A2.

Detention systems comprising box structures may provide a desirable high ratio of water volume to foot print area. However, compared to the inherent simplicity and strength of corrugated chambers, box structures require numerous, sometimes complex, strengthening features for resisting the overlying load of the soil, pavement and vehicles—along with lateral loads of the typical surrounding media within which the structures are buried.

Furthermore, a rectanguloid stormwater box system must be able to be economically manufactured, shipped/stored, and installed. The amount of plastic required for the product and the amount of labor required for assembly at the point of use are important factors. Chambers nest nicely for shipment and storage and require minimal onsite assembly, whereas many box like systems either do not nest nicely or require excessive assembly labor.

The installed cost of any new stormwater system should be competitive with prior art alternatives for handling the same amount of water, at least in the absence of enhanced benefits. There is a continuing need for improvements in design and manufacture of box type stormwater systems. When boxes are put to other uses than stormwater detention, such as for providing temporary raised platforms for equipment, much of the same needs apply.

SUMMARY

An object of the invention is to provide a plastic module that is useful for, among other things, receiving water when buried within permeable media. A further object is to provide a strong module which makes efficient use of thermoplastic material. Still further objects include that a module be economically manufactured, stored, shipped, and assembled.

In the present invention a module embodiment comprises at least a base and two or more plates that are engaged with and supported by columns that run through holes in the plate. An exemplary module may have six columns spaced apart in two rows of three columns. The columns are single piece, running from the base to the top of the module, and preferably have fiber or fabric reinforcement for strength and stiffness. During use, modules are abutted to each other to comprise a stormwater detaining array that is buried within permeable media fill.

In embodiments of the invention, a module base has a multiplicity of male or female fittings arranged in a first pattern on the base surface. A column runs vertically upward from each fitting and through a hole in each plate. For example, there may be six 123 cm (48 inch) long columns. There may be three nearly identical plates, with nominal 40 cm vertical spacing, and with the uppermost plate serving as a top of the module. Each plate has a plurality of holes arranged in the same pattern as are the fittings of the base.

There is a self-acting means for engaging each plate with each column. An exemplary self-acting means for engaging consists of a latch and a receiver. An exemplary latch is a male member such as a peg. An exemplary receiver is a female member such as cavity within the plate-hole or a peg-receiving hole in a deflectable perforated plate located within or in close proximity to the plate-hole. When the latch and receiver are brought into proximity to each other as a plate is raised or lowered along the length of a column, elastic bias in one of the receiver or latch causes the two elements to automatically engage with each other, thereby locking the plate against subsequent downward motion, optionally against upward motion as well.

In an embodiment of the invention, on a given column the angular orientation around the periphery of the column of the latching means is different at each plate's predetermined elevation. When, for example, the latch on the column is a peg, the second plate is configured to engage a peg at the second elevation but will not engage a peg that is at the first elevation. That is because there is within the hole of the second plate a receiver that corresponds in angular orientation with the angular orientation of the peg at the column second elevation. But there is no receiver within the second plate hole that corresponds with the orientation of the peg at the first elevation. Thus, the second plate will simply pass by the first elevation. When there is a third plate, the peg on the column is at an angular orientation which is different from the angular orientations associated with the first elevation and second elevation.

In an exemplary method of assembling a module, three plates are placed sequentially onto the base, one on top of the other. A column is passed through each of the sets of aligned holes and into a fitting of the base. Preferably, the base fitting only allows the column lower end to enter with a predetermined column rotational orientation about the column lengthwise axis. The uppermost plate on the base (which is the third plate) is then raised and it becomes automatically engaged at the top of the column (the "third elevation"). Then, raising the second plate causes it to be engaged at a lower second elevation. Then, raising the first plate causes it to be engaged at a still-lower first elevation. In a variation, when the detailing of the latch and receiver are slightly different, the plates are instead lowered onto upstanding columns, to become similarly engaged at respective predetermined elevations.

Various different self-acting means for engaging may be used. A preferred latching means comprises a peg (latch) that extends from the column and a receiver which is an elastically deflectable sheet positioned within a plate-hole for the column. The receiver is set within a vertical slot portion of the plate-hole.

The invention fulfils the objects of the invention. The components can be economically made and stored. A module may be assembled in the field near the work site or at the factory, with relatively small amount of work. The foregoing and other objects, features and advantages of the present invention will become more apparent from the following description of preferred embodiments and accompanying drawings

BRIEF DESCRIPTION OF THE DRAWINGS

FIG. 11A is a perspective cutaway view of a receiver which is integral with a plate within a slot of a hole through the plate.

FIG. 11B is a perspective view of a receiver which is separately formed and attached to a plate.

FIG. 12 is a top view of a column having pegs projecting from the cylindrical exterior surface.

FIG. 13 is an exploded perspective view of the column of FIG. 12.

DESCRIPTION

Figure 1:
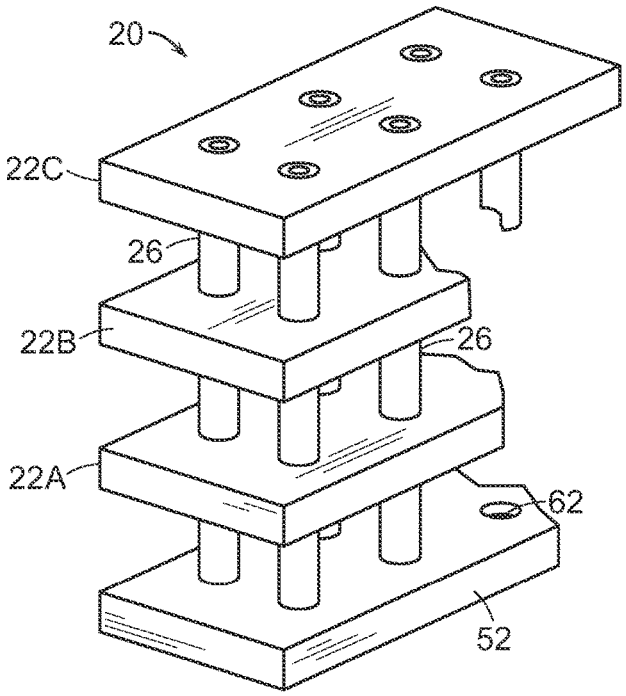
FIG. 1 is a perspective view of a module comprising plates that are secured to columns.
Figure 2:
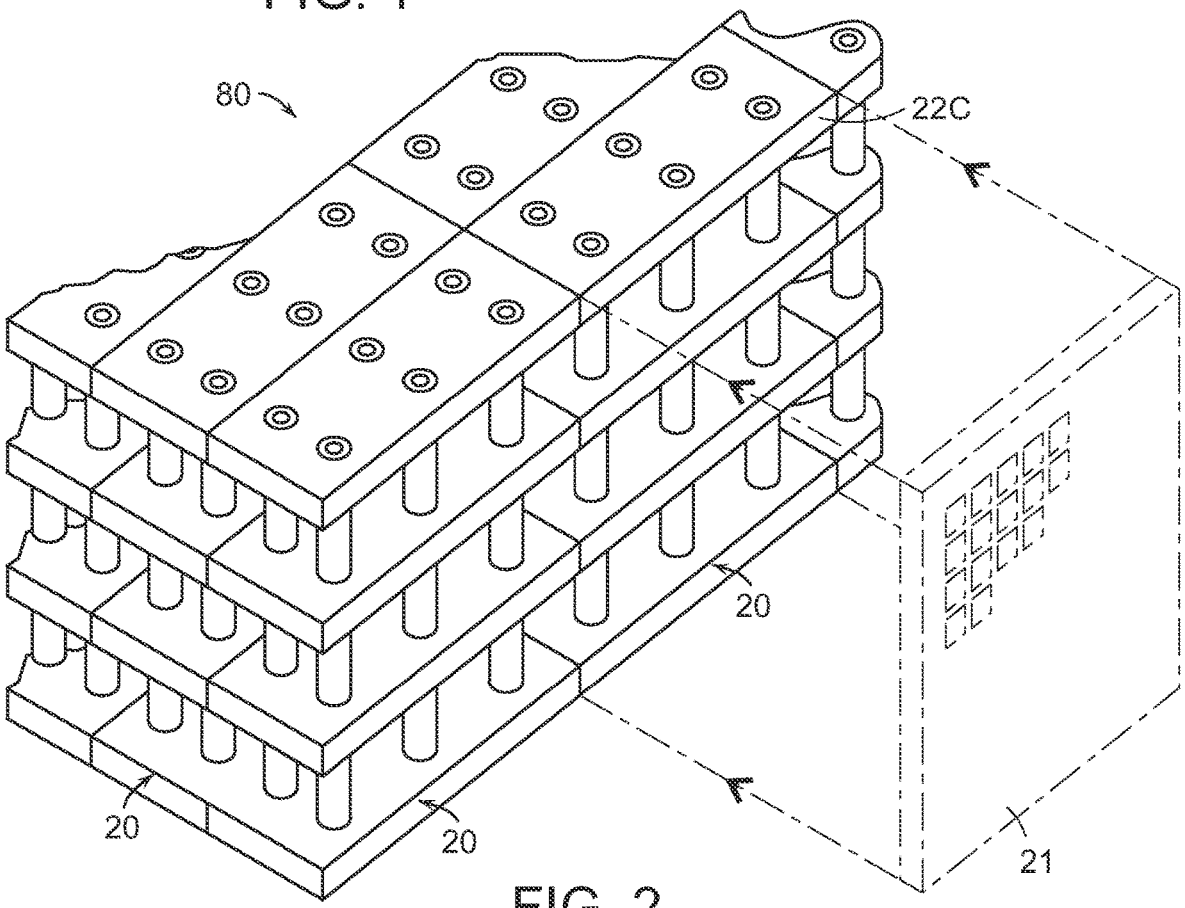
FIG. 2 is a perspective view of an array of modules with a side grating shown in phantom.

FIG. 1 is perspective view showing a portion of module 20, an embodiment of the present invention. Module 20 comprises base 52, vertical columns 26 and plates 22A, 22B, 22C (collectively plates 22). In this description, a reference to numbered-element, e.g., "plates 22" supra, is a reference to all the similarly-configured same-digit elements that have letter suffixes. In use for stormwater detention, a multiplicity of modules 20 may be placed in side by side rows as a module array 80, as shown in FIG. 2. An array may have other layouts and may comprise more than one layer of modules. Before an array is backfilled, to inhibit entry into the array of crushed stone or other granular media, gratings such as perforated panel 21, shown in phantom, will be secured to the exterior sides of the modules, often with an overlay of geotextile, not shown. During ordinary stormwater related use there will not be appreciable vertical loads on plates other than on the top plate. A plate that is positioned located between the base and the top plate helps columns resist any tendency to buckle.

Base 52 and plates 22 are preferably made of injection molded thermoplastics such as polyethylene or polypropylene. An exemplary rectangular plate 22 may be about 122 cm in length, about 61 cm in width, and about 9.5 cm in depth. Each plate will typically have a multiplicity of ribs along with perforations that enable both water passage lightness that reflects efficient use of material. For simplicity of illustration plate perforations and ribbing are not shown in the figures here. The foregoing kind of plate features may vary from one plate to the next.

Base 52 has a number of fittings equal to the number of columns on the base upper surface. In module 20 the fittings are sockets 62. See FIG. 1 and FIG. 3. See FIG. 21 for fittings which project upwardly. The upper surface of the base is substantially horizontal during use, in context that there are said fittings and there may be ribbing and perforations. The fittings are arranged according to a particular layout or pattern. In module 20 the pattern comprises two parallel rows of three spaced apart fittings. See FIG. 1 and FIG. 2. Each plate 22 has a plurality of through-holes 23 that are arranged according to a pattern that is the same as the pattern of the base fittings. Each hole is sized to enable a plate to slide vertically along a column. While module 20 comprises six columns 26, as do other exemplary embodiments described below, in the generality of the present invention there may be fewer columns or more columns. In other embodiments of the invention, columns need not be uniformly spaced apart; and, the base and plates may be non-rectangular in plan view.

Figure 20:
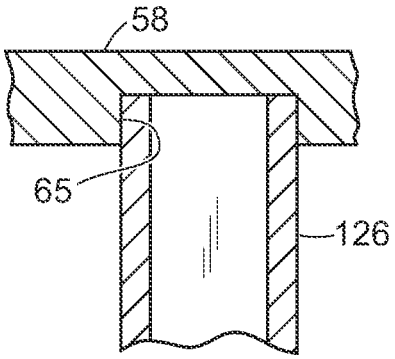
FIG. 20 is a partial elevation cross section of a top plate that is mounted on the upper end of a typical column of a module.

Plates 22 of module 20 are respectively secured to columns 26 at predetermined elevations to at least resist vertically downward movement. Optionally one or more plate is secured in a way which also resists upward movement. Three plates 22 are shown in module 20, with plate 22C forming the top of the module. In other embodiments of the invention there may be fewer or more plates. Plates may be unevenly spaced apart vertically, compared to the nominally uniform spacing shown in the examples here. A top plate that is different from the intermediate level plates 22 of module 20 is shown in FIG. 20 and is described below.

Columns 26, which are exemplarily hollow and have constant diameter, are preferably made of polyethylene, polypropylene, polyvinyl chloride, or other thermoplastics or thermosets. Columns may be produced by extrusion, pultrusion, and other well-known pipe and tube making processes. Columns may have filament or fabric reinforcement. An exemplary column may have an outside diameter of 10 to 15 cm and may be about 77 to 230 cm in length. Square or other cross section columns may be used in substitution of round columns.

A feature of the present invention is that when an array is one layer deep, the column may extend continuously from the bottom to the top of the array, compared to various prior art systems where smaller height modules are layered one on another to get a desired height of array. Continuous columns impart a desired stiffness to the structure, compared to having segmented columns, and compared to stacking two or more smaller height modules as in prior art. Notwithstanding, within the invention columns may also be elements which are comprised of segments.

Figure 3:
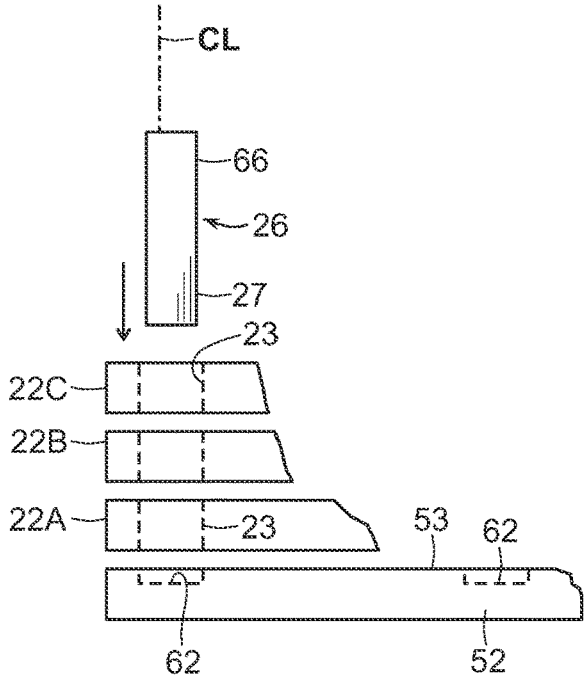
FIG. 3 is a partial side view of the components of a module as they are being set up for assembly.
Figure 4:
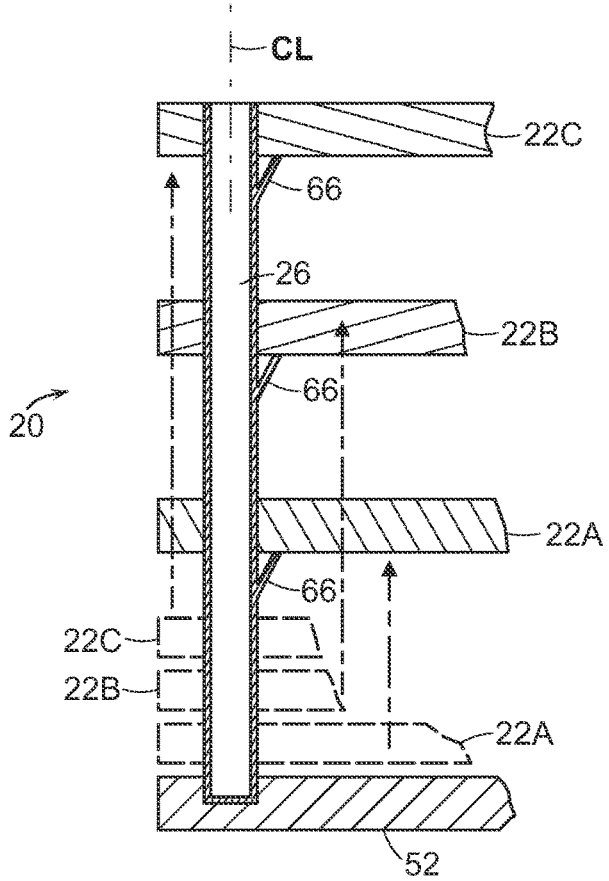
FIG. 4 is a partial side view of a module showing how the plates shown in FIG. 3 are serially raised to predetermined elevations.

Plates and columns of modules may be stacked or bundled for compact storage or shipment after manufacture. Modules may be assembled at a factory or the like, or at a jobsite. FIG. 3 and FIG. 4 show how parts of module 20 are assembled. First, as shown in FIG. 3, plates 22C, 22B, 22A are stacked one upon another on the upper surface 53 of base 52. Then, the lower end 27 of typical column 26 (along with the lower ends of other columns 26 that are not shown in FIG. 3 and FIG. 4) is passed through the aligned holes 23 in the stacked plates, as indicated by the arrow, and set within pocket 62 of base 52.

The arrows in FIG. 4 show how each of the three plates 22 is thereafter sequentially raised, so each plate reaches a predetermined elevation where the plate is engaged with the column to prevent subsequent downward movement, and optionally also to prevent also upward movement. Thus, plate 22C becomes engaged with the column at or near to the top; plate 22B becomes engaged with the column at a lower elevation; and plate 22A becomes engaged at a still lower elevation. An elastically deflectable latch 66, schematically drawn, holds each plate at its designated elevation.

The predetermined elevation of a plate is a function of the latching means, i.e., a function of mating engagement of a feature on the exterior surface of the column and a feature within a hole of the plate through which the column passes, or plate feature that is located on the plate upper surface or lower surface adjacent the hole. Each individual plate is automatically secured (latched) to the column at a predetermined elevation unique to that plate—which is accomplished by positioning latching means at selected angular orientations (or "clock positions") with respect to the column, when looking along centerline axis CL. Latching means may be alternatively referred to as engagement means herein.

Various exemplary latching means are described next. Later, there is description of how the latching means are angularly oriented with respect to the column circumference, so that a particular plate will be secured only at a particular elevation.

In embodiments of the invention, each plate 22 is secured at a desired predetermined elevation by a latching means that comprises a latch element and a receiver element. Typically, the latch element is a male element that is shaped to enter into a hole or concavity of the receiver female element.

In one approach, the latching means comprises a latch that is attached to or integral with the column 26 and a receiver that is attached to or integral with a plate 22. In another approach, the latching means comprises a latch that is attached to or integral with the plate and a receiver that is attached to or integral with the column. A latch or receiver that is a non-integral separately-formed element may be attached to the column or plate, as applies, by being fastened, adhered, welded and so forth. For simplicity of illustration, the figures discussed hereafter show only one typical column of the six columns of an exemplary module. Arrows in the figures indicate motions of a plate or a latching means element. FIG. 5 through 9 show different exemplary latching means.

Figure 5:
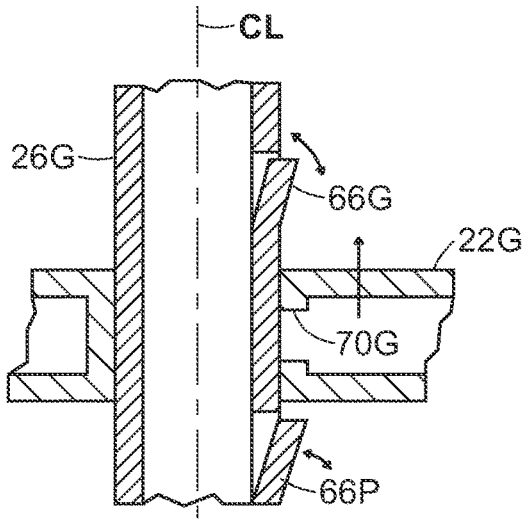
FIG. 5 is a fragmentary cross section detail of a plate being to an elevation at which a latch projects outwardly from the column surface.

FIG. 5 shows a portion of a column 26G as it is positioned within a hole through plate 22G. Latch 66G is an integral elastically deflectable tab that projects outwardly from the surface of the column. When first contacted by upward-moving plate 22G, the latch is pushed into a recess on the column. With further upward plate motion, the latch springs outwardly into the concavity of receiver 70G (an opening in the bore of the hole in the plate), thereby preventing the plate from moving downwardly. The plate may be raised further if desired.

FIG. 5 also illustrates, by example of phantom latch 66P, that within the present invention how a component of the latching means can be located on the underside (or in other analogous embodiments on the upper side) of the plate adjacent to the column-hole, rather than within the column-hole. Latch 66P is engaged with the bottom surface of the plate, which bottom surface acts as receiver. Latch 66P which may be used in place of, or in addition to, latch 66G.

Figure 6:
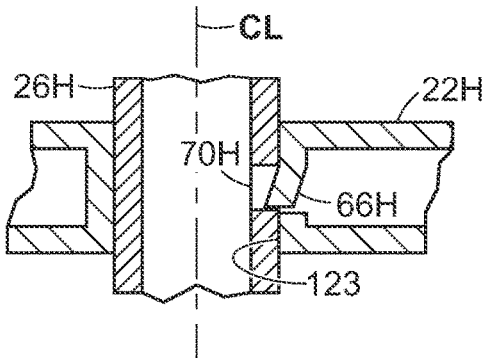
FIG. 6 is a fragmentary cross section of a column and a plate having a latch that is engaged with a receiver which is a hole in the column surface.

FIG. 6 shows column 26H positioned in hole 123 of plate 22H where it is latched to the plate. Latch 66H is an integral elastic tab that, before a column was present within the hole, projected into the bore of the hole 123. Receiver 70H is a hole, alternatively a cavity, in the surface of column 26H. When plate 22H was being raised along the column to the elevation of receiver 70H, the cantilever end of latch 66H was pushed into plate 22H by the column exterior surface. When plate 22H reached the elevation of receiver 70H, the elasticity of latch 66H caused its cantilever end to enter receiver/hole 70H, thereby preventing lowering of plate 22H. The plate may still be raised further if desired.

Figure 7:
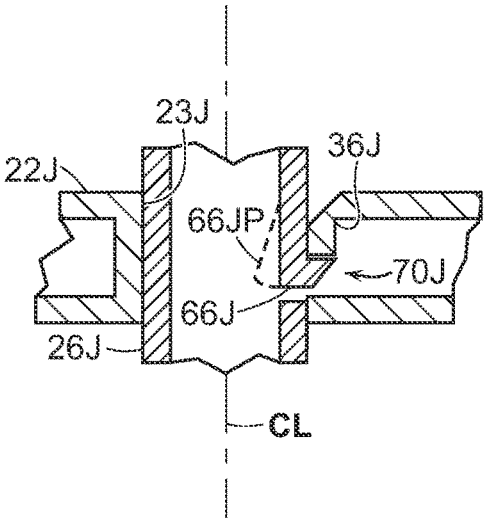
FIG. 7 is a fragmentary cross section of a plate and column assembly having a latch that is engaged with the receiver, a hole in the plate, thereby holding the plate at an elevation.

FIG. 7 shows column 26J that is positioned within hole 23J of plate 22J. Column 26J comprises latch 66J that in cross section is a L shape elastic member. The tip of the short leg of the "L" is biased to project outwardly from the surface of the column. As plate 22J was being raised, bevel 36J of hole 23J contacted the short leg tip of latch 66J, pushing the latch elastically into the column interior, as the phantom 66JP indicates. With further upward motion of the plate, the tip of latch 66J entered receiver 70J, which is a radial (horizontal) hole in the bore of the hole 23J. The plate is prevented from further motion upwardly or downwardly.

Figure 8:
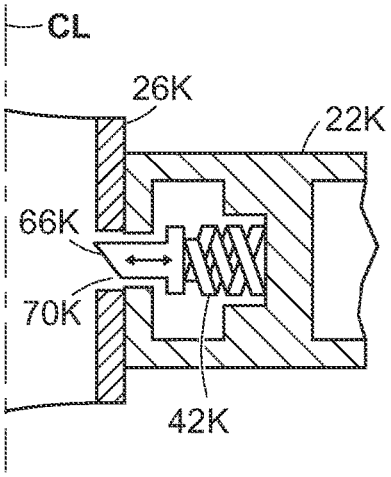
FIG. 8 is a fragmentary cross section of a column with a plate that has a spring biased latch.

FIG. 8 shows column 26K that is positioned within the hole of plate 22K. Receiver 70K is a hole in the side of the column. Latch 66K is a movable pin set within the plate; latch 66K is urged by spring 42K toward the column. When plate 22K was being raised to proximity of receiver 70K the spring was compressed. When the plate reached the elevation of receiver 70K, the latch/pin 66K engaged the receiver, and as shown in FIG. 8; the plate can no longer be moved up or down. In another embodiment, not shown, latch 66K may be located in a housing attached to the underside or upper side of plate 22K.

Figure 9A:
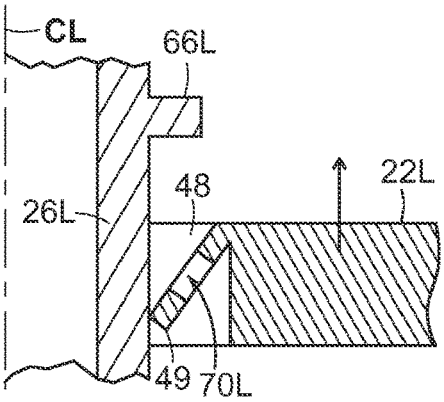
FIGS. 9A, 9B and 9C are sequential fragmentary cross section views of a column along which a plate is shown in progressive stages of being raised, so the latch (peg) that projects from the column becomes engaged with the receiver which is a slot in the plate.
Figure 9B:
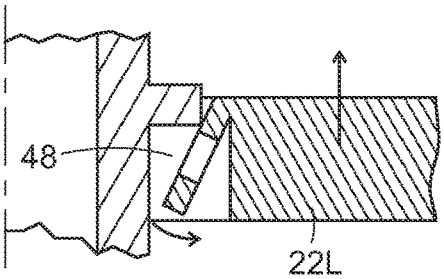
Figure 9C:
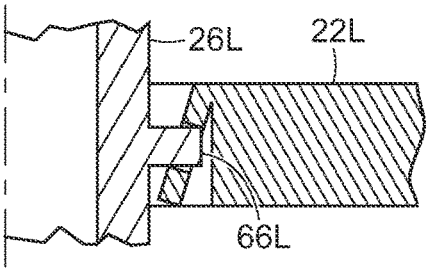
Figure 10A:
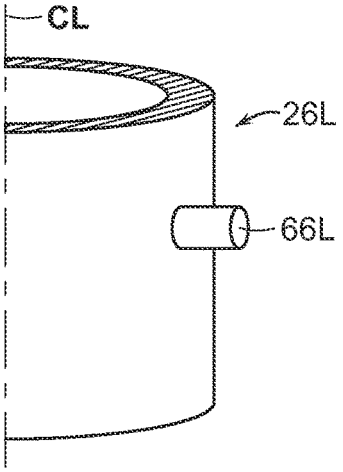
FIG. 10A is a perspective view of a portion of a column showing a latch with cantilever peg.
Figure 10B:
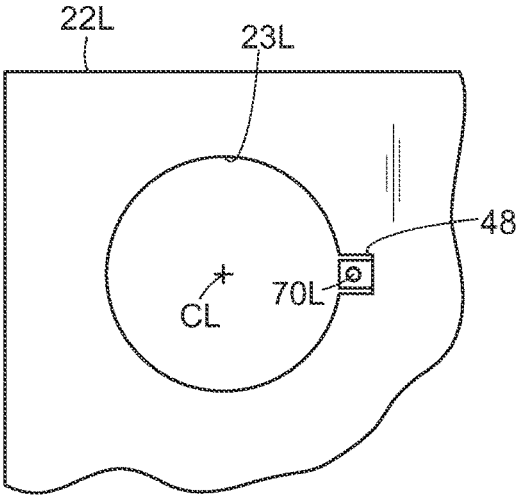
FIG. 10B is top view of a plate having an opening that fits the column of FIG. 10A.

FIGS. 9A, 9B and 9C show the progressive stages of latching engagement of plate 22L as it is being raised along the length of column 26L, as indicated by the arrows. FIG. 10A shows a portion of column 26L which has a peg/latch 66L that projects from the surface of column 26L. FIG. 10B is a top view of a portion of plate 22L, showing hole 23L within which column 26L is slidingly received. Slot 48 extends radially from the bore of hole 23L. Within slot 48 is receiver 70L, the cantilever end of which projects toward the center of hole 23L. See also the perspective cutaway of plate 22L in FIG. 11A. Receiver 70L is integral with plate 22L and is comprised of elastic thermoplastic. As shown in FIG. 9A, when plate 22L is being raised, the cantilever end 49 of receiver 70L extends outward, to touch or nearly touch the column surface. As plate 22L is raised, receiver 70L is deflected away from the column and into the slot by contact of the receiver with latch/peg 66L. See FIG. 9B. Then, with further upward motion of the plate, peg 66L enters hole 44 of the receiver and the receiver simultaneously springs toward the column, as shown in FIG. 9C, thereby locking plate 22L from further motion upwardly or downwardly.

Figure 19:
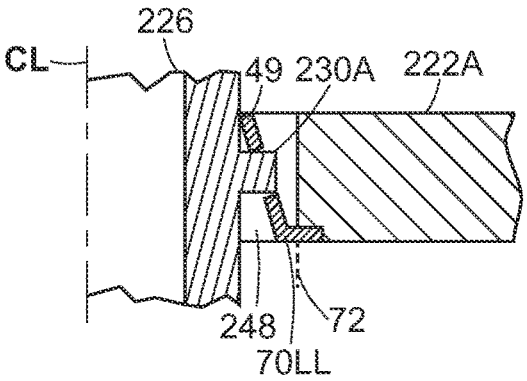
FIG. 19 is shows a detail of the FIG. 19 module, illustrating engagement of a plate with the column.

FIG. 11B illustrates receiver 70LL that may be used in place of the integral receiver 70L. Receiver 70LL is a separate element formed of elastic sheet material, such as plastic or corrosion resisting metal, and is attached to the plate by a pin or screw passed through hole 46 in the short leg of the receiver. FIG. 19, discussed below, shows an example of such attachment.

In some of the examples above, the latch element or receiver element of the latching means is located within a slot of the column-receiving hole of the plate. In other examples, there is no slot. Since a vertical slot is a perturbation or a portion of a hole, a latching means element that is within a slot is properly characterized as being inherently within the hole of the plate.

Latch and receiver combinations described above are said to comprise self-acting engaging means. By that is meant that latching engagement of a latch with a receiver takes place when those two elements of the engaging means come into proximity, without needing the assembler person to act directly on the elements of the latching means. In the invention, latching means may be used that are not self-acting. For example, in FIG. 8, spring 42K could be eliminated and the assembler person would move the latch 66K manually so it enters hole 70K.

Figure 15:
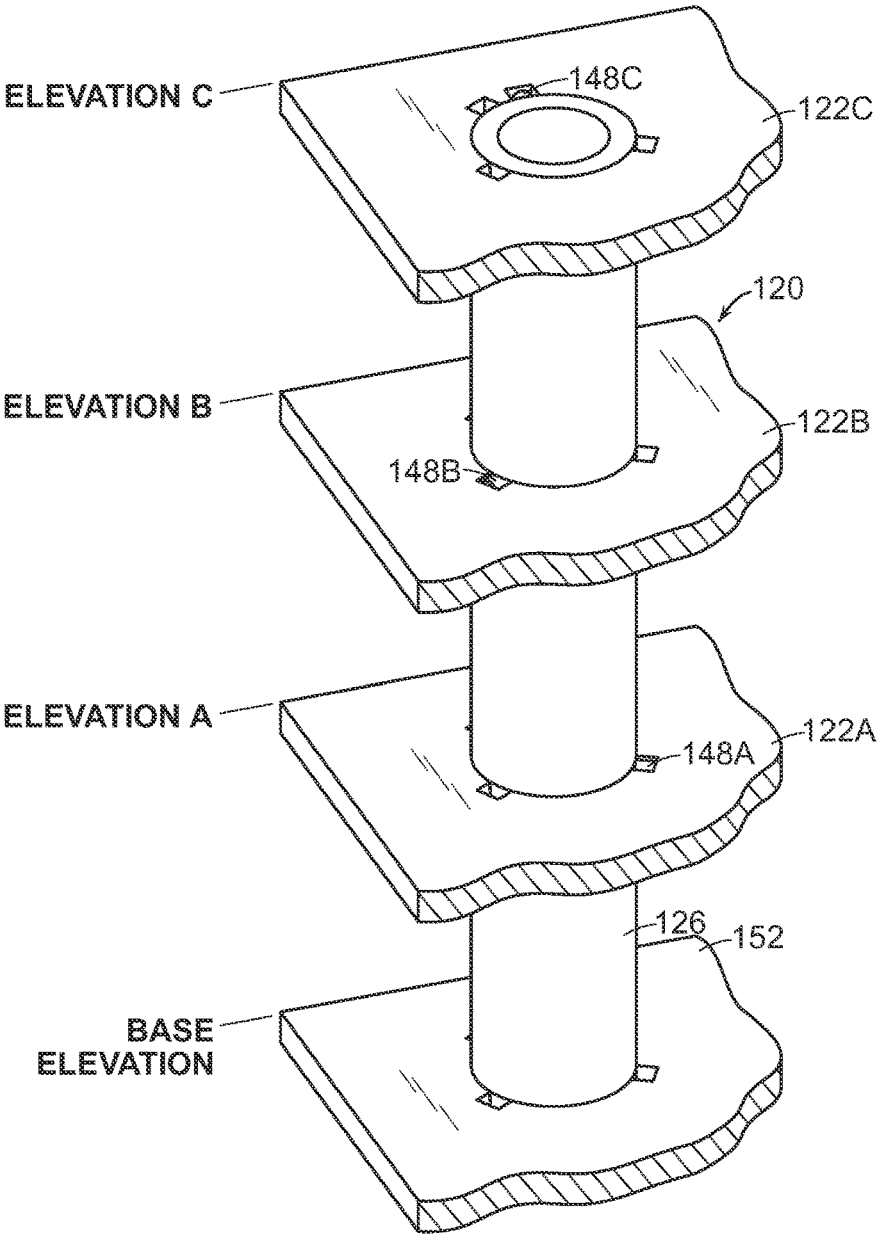
FIG. 15 is a fragmentary perspective view of a module showing the column of FIG. 12 that is extending upwardly from abase, with three plates are secured to the column at three different elevations.

How each plate is latchingly engaged at a singular predetermined elevation will now be described. FIG. 15 is a perspective view of the corner of a module 120 comprising six columns 126 (only one shown), base 152, and plates 122A, 122B, 122C, each at a respective elevation A, B, C that is measured from the base.

FIG. 13 is an exploded perspective view showing how the plates, columns, and base were arranged to carry out assembly of module 120. (What FIG. 13 shows is analogous to what FIG. 3 shows.) The plates 122 are first stacked on the surface of base 152. Then columns 126 are passed through the aligned holes of the plates and each column's lower end is set within a fitting on the base surface, namely pocket 162. Thereafter, each plate has been sequentially raised and has become automatically engaged with a particular column peg 30, thus creating module 120 shown in FIG. 15. The arrangement of latching means amongst the columns and plates of module 120 is such that any given plate 122 will only be automatically latched at one elevation.

Figure 14:
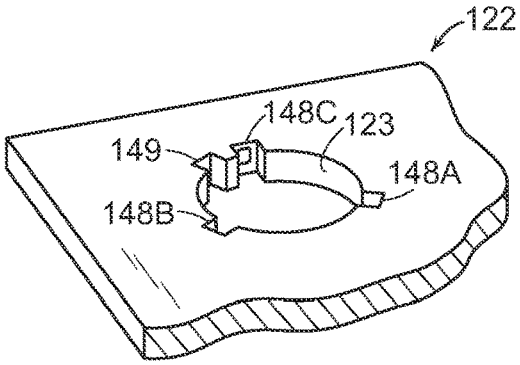
FIG. 14 is a partial perspective view of the upper surface of a plate having a hole shaped to slidingly move along a column of FIG. 12.

FIG. 12 is a top view of column 126. FIG. 14 is a perspective view of a plate 122 showing a typical hole 123 with its several slots 148 for accommodating pegs 30, along with slot 149 that accommodates passage of peg 30B, which is at the lower end of the column 126.

Pegs 30 project radially outward from column 126 at three different elevations measured from the surface of the base plate: Peg 30A is at elevation A for engaging a receiver of plate 122A; peg 30B is at elevation B for engaging a receiver of plate 122B; peg 30C is at elevation C, for engaging a receiver of plate 122C. Peg 30BB engages a slot 40BB in the base and serves to orient the column rotationally with respect to the base.

Referring again to FIG. 12, each peg 30 has an angular orientation about center axis CL, i.e., within a plane that is orthogonal to axis CL, that is unique to the peg/elevation. Location R is an arbitrary "zero" or reference position. It happens to be the location of peg 30C. One way of characterizing the arrangement of pegs is that pegs 30A, 30B, 30C are separated by circumferential angle F, for example 120 degrees. Peg 30BB is about at angle G, for example 30 degrees from location R. Another way of characterizing the circumferential disposition of pegs is that pin 30C and location R is at about 12 o'clock, pin 30A is at about 4 o'clock, and pin 30B is at about 8 o'clock. Different and irregular angles of orientation, or clock positions, may be used IN other embodiments of the invention.

FIG. 14 shows that each hole 123 in each plate 122 of module 120 comprises three slots 148 that have angular orientations corresponding with the orientations of pegs 30. Suppose all the slots of each hole in a plate 122 were plain, i.e., there was no latching means associated with any slot. Then, the plate would be able to move along the length of columns 126 without being impeded by the pegs. In module 120, for each plate one only of the slots of each hole 123 is fitted with a receiver that like the receiver 70L shown in FIG. 9A.

In the module 120 plate 122C has a receiver in slot 148C only. Thus, the plate will engage only peg 30C which is at the top of column 126. As plate 122C was raised upwardly, it would not engage pegs 30A or 30B because there is no receiver within either of slots 148A, 148B that angularly correspond respectively with pegs 30A, 30B.

Likewise, plate 122B has a receiver only in slot 148B. Thus, when raised, plate 122B will pass by peg 30A at elevation A and will become latched when it reaches peg 30B at elevation B. Similarly, when raised, plate 122A will become latchingly engaged with the column at elevation A.

While the latching means of module 120 comprises a latch (a peg) extending from the column and a receiver attached to the plate, in other module embodiments the latch may extend from the plate and the receiver may be on the column exterior. See FIG. 8. Other latch and receiver configurations may be used, including those described in connection with FIG. 5 to FIG. 7. Each plate preferably is engaged with each column by a least one latching means. In the generality of the invention, some plates may not be latchingly engaged to every column.

Figure 16:
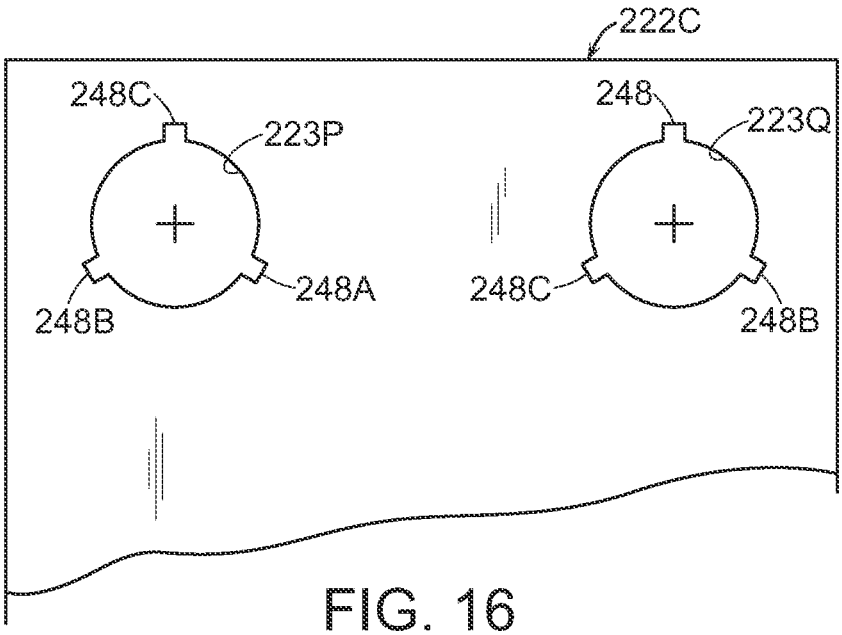
FIG. 16 is a partial top view of a plate showing two holes of the six holes shaped for receiving columns when the plate is part of a module.

In an exemplary module 120 all columns are identical, and for a given plate all pegs of all columns will have the same angular orientation. For example, at elevation A, each column will have a peg at the 4 o'clock position. In other embodiments, the angular orientation of such pegs may vary from one column to the next for a given plate/elevation. For example: FIG. 16 shows in top view exemplary plate 222C having hole 223P and hole 223Q. Each hole comprises slots 248A, 248B, 238C to accommodate column pegs which are angularly spaced apart by 120 degrees around the column. Within each slot 248C is a receiver 70L (not shown) that will hold the plate 22C at elevation C. Slot 248C is at 12 o'clock in hole 223P. Slot 284C is at 8 o'clock in hole 223Q.

Figure 17:
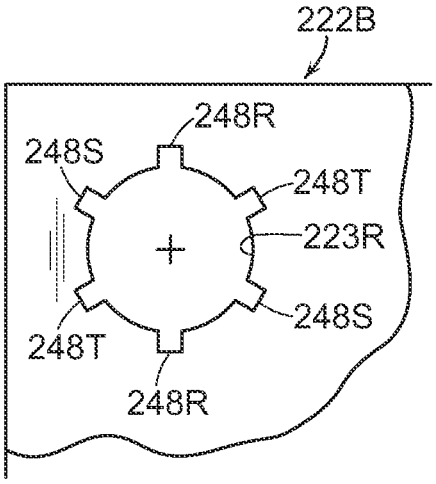
FIG. 17 is a partial top view of a plate showing a one of the six holes for receiving columns, in particular, for a column having as two pegs at each elevation.

In another embodiment, a typical column may engage a plate at two or more angular orientations. FIG. 17 shows in top view plate 22B that has a hole 223R that has two pairs of each slots 248R, 248S, and 248T. The slots of each pair are spaced 180 degrees apart. Each column (not shown) will be like column 126 in FIG. 13, except that at each elevation R, S, T there will be two pegs instead of one—and the two pegs will be spaced apart 180 degrees around the circumference of the column. Thus, for example, representative plate 222B will have a receiver 70L (not shown) within each slot of opposing slot pair 248T. Thus, plate 222B will be engaged to the column at elevation B by two opposing side latching means comprising opposing side pegs and associated opposing side receivers in slots of the plate holes.

In the examples, the latching means are self-actuating, i.e., the latch and receiver become engaged with each other without the intervention of a worker. The practice of using the circumferential angular orientation of the latching means to determine the elevation at which a plate will be secured can be carried out with a non-self-actuating latching means, e.g., where a worker provides motive force to a latch element in substitution of a spring.

As may have been appreciated by the reader, it is important that each column have a correct angular orientation relative to the base, i.e., in the horizontal plane, so that the pegs of the columns align well with the notches in the holes running through the plates. One way of achieving that correct columnar orientation is by means of column peg 30BB and mating slot 40BB of base fitting 162. See FIGS. 12 & 13. See also FIGS. 21 & 22 that are discussed below.

During assembly, columns may be correctly oriented on the base by using a mechanical fixture, or simply by diligence in manual setup by an assembler. In an invention embodiment, not pictured, the lower end of each column has an irregular or peculiar shape that allows the column to only be engaged with a mating molded fitting so the column has singular lengthwise-axis-rotational orientation. For instance, a pocket in the base could be circular with a chord-like flat-surface portion. The exterior surface of the lower end of the column would have a corresponding male shape.

Referring again to FIG. 13, the slot 40BB portion of the 162 of base 152 may have a receiver that is like, or functionally equivalent to, receiver 70L or receiver 70LL of FIG. 11A, 11B. The receiver will latchingly engage a peg on the bottom of the column and prevent its removal from the base without the use of a tool. Use may be made of other column-securing means, such as screws or other fasteners that require a tool for removal. Still further, non-removable securing means such as strong adhesives or welding may be used.

Figure 21:
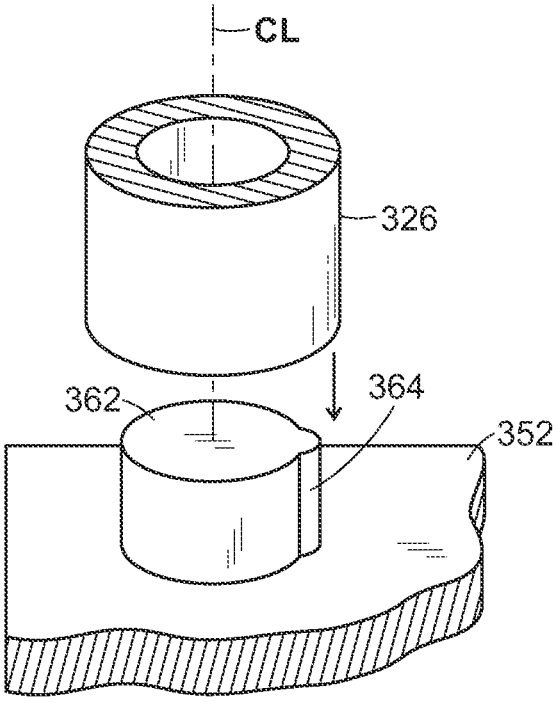
FIG. 21 is a partial exploded perspective view of a base and column that mates with an upwardly-projecting fitting comprising a lengthwise nub.
Figure 22:
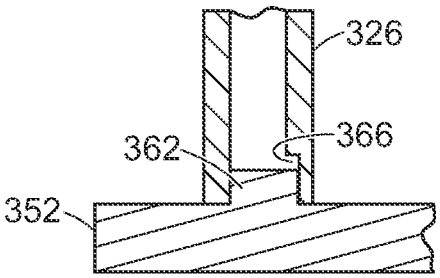
FIG. 22 is a vertical cross section of the base and column shown in FIG. 21 with the column now mated with the fitting.

FIG. 21 and FIG. 22 show a base 352 having a fitting 362 which is a stub pillar that projects upwardly from the surface of the base and fits within the bore of column 326. As shown, fitting 362 has a lengthwise running nub 264 that fits within a groove 366 within the bore of column 326, for positive horizontal plane angular orientation of the column with respect to the base surface and horizontal plane. In still other embodiments of the invention, the base fittings comprise upwardly extending collars, not shown.

Figure 18:
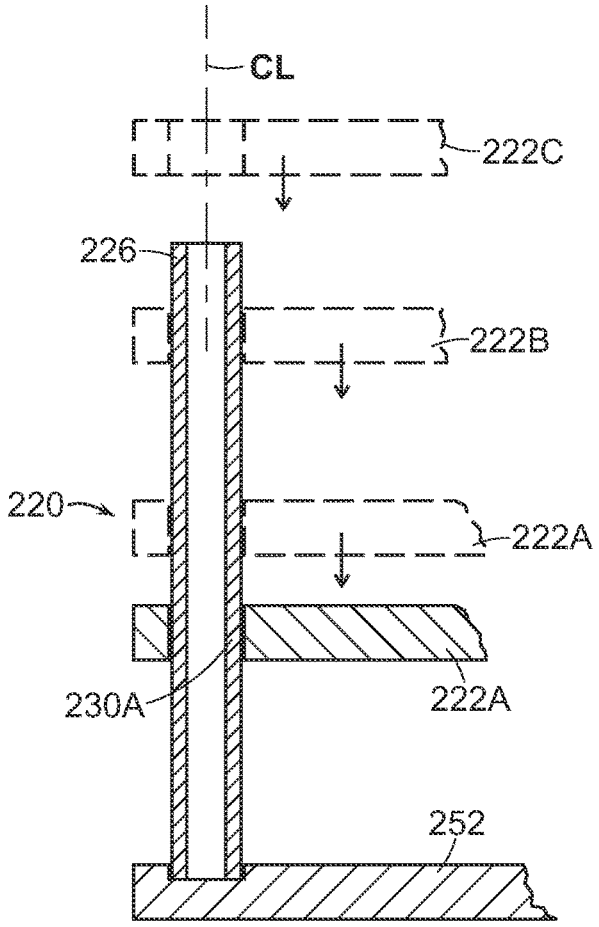
FIG. 18 is a partial elevation cross section of a module in the process of being formed, showing how plates are being lowered along the column length to their predetermined elevations.

In another embodiment of module and method of assembly of the present inventions, plates can be lowered along columns (rather than raised) to predetermined elevations at which they become secured to the columns. FIG. 18 shows a portion of module 220, an embodiment comprising three plates 222 and six columns 226 (only one pictured) which extend upwardly from base 252. Module 220 is formed by serially lowering plates 222 to each plate's predetermined elevation along column 226, as indicated by the arrows associated with the phantom plates 222A, 222B, 222C. Plate 222A is shown in final position, engaged to column 226.

FIG. 19 is a detail of the latching engagement of typical plate 222A with typical column 226. Column 226 is like column 126 in having pegs at three different elevations. Only peg 230A at the elevation of lower plate 222A is visible in FIG. 18. Each plate 222 comprises a receiver 70LL located within a slot 248 of a hole through the plate. Receiver 70LL is shown in FIG. 11 and is attached by a fastener (schematically illustrated by line 72). The cantilever end 49 of receiver 70L angles upwardly and toward the column. Thus, as a plate is lowered the peg first deflects receiver elastically away from the column; and with further lowering, the receiver springs toward the column and the peg projects through the opening 44 of the receiver, thereby locking the plate against further upward or downward motion. (This is analogous to what is shown in FIG. 9A, 9B, 9C. A module formed by lowering plates, may in other embodiments, employ the many different ways of securing a plate to a column that have been described in connection with modules 20 and 120.

In substitution of using plate 122 as the top plate of a module, atop 58 that is uniquely configured for such purpose can be set on the upper ends columns 126, as shown in FIG. 20. Top 58 has a multiplicity of pockets 65, each shaped to receive the upper end of a column. Pocket 65 may have a receiver with a slot thereof, to hold the top in engagement with upper peg 30BB. In another embodiment, top 58 can comprise only plain pockets, and there may be no column peg nor slot in the plate. In another embodiment, a top may have nubs that extend downwardly to fit within the bore of the column. A top plate may be secured to the top ends of columns by latching means, fasteners, adhesives and the like.

The invention fulfils the objects of the invention. The components can be economically made and stored. A module may be assembled in the field near the work site or at the factory, with relatively small amount of work. The invention has been described with respect to an industrial and commercial use, namely detaining stormwater and other liquids when buried in liquid permeable media, such a stone, gravel, sand or soil. The invention can have other uses, such as providing quickly assembled shelving, storage racks, or support structures for objects.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A module for receiving stormwater when buried in permeable media, comprising:

a base having a substantially horizontal upper surface and a multiplicity of fittings arranged on the upper surface in a first pattern;

a plurality of columns extending vertically from the base, each column having a lengthwise axis, an upper end, and a lower end, each lower end being mated with one of said fittings;

a first plate, situated at a first elevation from the upper surface, the first plate having a plurality of holes arranged according to said first pattern, wherein each column extends slidably lengthwise through one of said holes;

a plurality of self-acting engaging means comprising a latch and a receiver, configured to secure the first plate to each column at the first elevation and to prevent downward motion of the first plate; and, a second plate, situated at a second elevation from the upper surface, the second elevation being higher than the first elevation, the second plate having a plurality of holes arranged according to said first pattern, wherein each column extends slidably lengthwise through one of said holes; and, a plurality of self-acting engaging means comprising a latch and a receiver, configured to secure the second plate to each column at the second elevation and to prevent downward motion of the second plate;

wherein, with respect to angular orientation about the lengthwise axis of each column of a multiplicity of said plurality of columns, the angular orientation of the receiver of the plurality of self-acting engaging means of the first plate is different from the angular orientation of the receiver of the plurality of self-acting engaging means of the second plate.

2. The module of claim 1 further comprising a third plate situated at a third elevation from the upper surface, the third elevation being higher than the second elevation, the third plate having a plurality of holes arranged according to said first pattern, wherein each column extends slidably lengthwise through one of said holes; and, a plurality of self-acting engaging means comprising a latch and a receiver, configured to secure the third plate to each column at the third elevation and to prevent downward motion of the third plate;

wherein, with respect to orientation about the lengthwise axis of each column of a multiplicity of said columns, the angular orientation of the receiver of the plurality self-acting engaging means of the third plate is different from the angular orientation of the receiver of the plurality of self-acting engaging means of both the first plate and the second plate.

3. The module of claim 1 wherein each lower end is fastened, adhered, or latchingly engaged with the base.

4. The module of claim 1 wherein the base and each plate have a rectangular shape comprising a length and a width and wherein said first pattern comprises three pairs of columns spaced apart lengthwise.

5. The module of claim 1 wherein the angular orientation of the self-acting engaging means for at least one of the first plate or the second plate is the same for each column of the plurality of columns.

6. The module of claim 1 wherein each lower end and its mated base fitting are configured so that each column has a predetermined single angle of orientation about the lengthwise axis of the column.

7. The module of claim 6 wherein each lower end is fastened, adhered, or latchingly engaged with the base.

8. The module of claim 1 wherein the self-acting engaging means further prevents upward movement of at least one of the first plate and the second plate.

9. The module of claim 1 wherein, for each of the first plate and the second plate, the self-acting engaging means comprises a latch and a receiver, the latch comprising a peg extending from the exterior of the column and the receiver comprising a deflectable member having a hole to receive a portion of the peg.

10. The module of claim 9 wherein, for each of the first plate and the second plate, at each of said plurality of columns the self-acting engaging means comprises two of said latch and receiver combinations, wherein the pegs of said latches are circumferentially-spaced apart around the column.

11. The module of claim 1 wherein, for each of a multiplicity of said columns and for either or both the first plate and the second plate, the self-acting engaging means comprises a receiver on the exterior of a column and a latch within the plate hole within which the column is positioned.

12. The module of claim 1 wherein, for each of a multiplicity of said columns and for either or both the first plate and the second plate, the self-acting engaging means comprises a latch on the exterior of a column and a receiver within the plate hole within which the column is positioned.

13. The module of claim 1 wherein, for each of a multiplicity of said columns and for either or both the first plate and the second plate, the self-acting engaging means comprises a latch that is elastically deflectable.

14. The module of claim 1 wherein, for each of a multiplicity of said columns and for either or both the first plate and the second plate, the self-acting engaging means comprises a receiver that is elastically deflectable.

15. The module of claim 1 further comprising a top having a plurality of top fittings arranged according to said first pattern, each top fitting being mated with the upper end of each column.

16. A multiplicity of modules of claim 1 arranged as an array of modules within a cavity in the earth, each module in touching contact or near touching contact with at least one other module; further comprising a plurality of grates secured to the vertical sides of a multiplicity of modules.

17. A method of assembling a module of claim 1 comprising:

placing the first plate on the upper surface of the base, wherein the first plate holes align with said base fittings;

placing the second plate on top of the first plate, wherein the second plate holes align with the holes of the first plate;

for each column of said plurality of columns, inserting a lower end into and through the aligned holes of said first and second plates;

mating the lower end with a base fitting;

lifting the second plate upwardly past the first elevation to the second elevation, wherein the self-acting engaging means becomes engaged, to prevent subsequent downward motion of the second plate from the second elevation; and lifting the first plate upwardly to the first elevation, wherein the self-acting engaging means becomes engaged, to prevent subsequent downward motion of the first plate from the first elevation.

18. A method of assembling a module of claim 1 comprising:

mating the lower end of each column of said plurality of columns with a fitting on the upper surface of the base;

placing the first plate onto the columns so the upper end of each column passes through one of the holes of the first plate;

lowering the first plate downwardly past the second elevation to the first elevation, wherein the self-acting engaging means becomes engaged, to prevent subsequent downward motion of the first plate from the first elevation;

placing the second plate onto the columns so the upper end of each column passes through one of the holes of the second plate; and lowering the second plate downwardly to the second elevation, wherein the self-acting engaging means becomes engaged, to prevent subsequent downward motion of the second plate from the second elevation.

19. The method of claim 18 wherein the self-acting engaging means comprises a latch which is a peg and a receiver which is a deflectable perforated plate.

20. A module for receiving stormwater when buried in permeable media, comprising:

a base having a substantially horizontal upper surface and a multiplicity of fittings arranged on said upper surface in a first pattern;

a plurality of columns extending vertically from the base, each column having a lengthwise axis, an upper end, and a lower end, each lower end mated with one of said fittings, wherein the lower end of each column and each fitting with which the column lower end is mated are configured so that the column has a predetermined single angle of angular orientation about the lengthwise axis and wherein the lower end is kept from being un-mated from the fitting without the use of a tool;

a first plate, situated at a first elevation from the upper surface of the base, the first plate having a plurality of holes arranged according to said first pattern, wherein each column extends lengthwise through one of said holes;

a plurality of engaging means comprising a latch and a receiver, configured to secure the first plate to each column at the first elevation and to prevent upward or downward motion of the first plate, wherein the latch comprises at least one peg extending from an exterior of the column and the receiver comprises at least one member having an opening shaped to receive the end of a peg, said at least one member located within the hole of a plate, and, a second plate, situated at a second elevation from the upper surface, wherein the second elevation is higher than the first elevation, the second plate having a plurality of holes arranged according to said first pattern, wherein each column extends lengthwise through one of said holes; and, a plurality of engaging means each comprising a latch and a receiver, configured to secure the second plate to each column at the second elevation and to prevent upward or downward motion of the second plate, wherein the latch comprises at least one peg extending from an exterior of the column and the receiver comprises at least one member having an opening shaped to receive the end of a peg, said at least one member located in the hole of a plate, wherein, with respect to angular orientation about the lengthwise axis of each column of a multiplicity of said plurality of columns, the angular orientation of the receiver of the plurality of engaging means of the first plate is different from the angular orientation of the receiver of the plurality of engaging means of the second plate.

21. The module of claim 20 wherein each of the plurality of engaging means is self-acting.

* * * * *